US010088102B2

(12) United States Patent
Aguiar et al.

(10) Patent No.: US 10,088,102 B2
(45) Date of Patent: Oct. 2, 2018

(54) SHROUD ASSEMBLY FOR A PORTABLE PRESSURIZED GAS CYLINDER

(71) Applicant: AMTROL Licensing Inc., West Warwick, RI (US)

(72) Inventors: Carlos Aguiar, Oporto (PT); Filipe Pedrosa, Matosinhos (PT)

(73) Assignee: AMTROL LICENSING INC., West Warwick, RI (US)

( * ) Notice: Subject to any disclaimer, the term of this patent is extended or adjusted under 35 U.S.C. 154(b) by 0 days.

(21) Appl. No.: 15/443,177

(22) Filed: Feb. 27, 2017

(65) Prior Publication Data

US 2017/0254476 A1 Sep. 7, 2017

Related U.S. Application Data

(60) Provisional application No. 62/304,695, filed on Mar. 7, 2016.

(51) Int. Cl.
*F17C 1/02* (2006.01)
*F17C 1/00* (2006.01)

(52) U.S. Cl.
CPC ..... *F17C 1/00* (2013.01); *F17C 1/02* (2013.01); *F17C 2201/0128* (2013.01);
(Continued)

(58) Field of Classification Search
CPC ... B65D 11/105; B65D 11/10; B65D 11/1886; B65D 11/188; B65D 25/18; B65D 21/0233; B65D 1/40; B65D 11/18; B65D 81/3876; B65D 90/12; F17C 1/04; F17C 1/02; F17C 1/00
USPC ..... 220/586, 324, 581, 4.25, 4.24, 4.21, 220/23.89, 23.87, 23.83, 23.91, 691, 690, 220/682, 4.05, 4.06, 4.07, 4.08, 4.09, 737,
(Continued)

(56) References Cited

U.S. PATENT DOCUMENTS 2,381,396 A * 8/1945 Kuhn ..... F17C 1/06 220/592
3,358,118 A * 12/1967 Mather et al. ..... F17C 1/12 122/19.2

(Continued)

FOREIGN PATENT DOCUMENTS

CA 2518878 A1 * 3/2006 ..... F17C 1/04
EP 1710486 A1 10/2006
KR 101351871 B1 1/2014

OTHER PUBLICATIONS

Search Report in corresponding European Patent Application No. EP 17159103 dated Aug. 1, 2017.

*Primary Examiner* — Robert J Hicks
(74) *Attorney, Agent, or Firm* — Tucker Ellis LLP; Carlos Garritano; Patrick Clunk

(57) ABSTRACT

A portable gas cylinder assembly which includes a gas cylinder having a central axis, a protective shroud configured to encase the gas cylinder and including opposed half-sections mechanically connected to one other along a vertical plane intersecting the central axis of the gas cylinder, a cover member, separate from the opposed half-sections of the protective shroud, for supporting a lower portion of the gas cylinder within the opposed half-sections, and a base member, separate from the opposed half-sections of the protective shroud, for supporting a lower portion of the gas cylinder within the opposed half-sections.

14 Claims, 19 Drawing Sheets

(52) U.S. Cl.
CPC .. *F17C 2201/032* (2013.01); *F17C 2201/058* (2013.01); *F17C 2203/0604* (2013.01); *F17C 2203/0619* (2013.01); *F17C 2203/0636* (2013.01); *F17C 2203/0658* (2013.01); *F17C 2203/0663* (2013.01); *F17C 2205/0115* (2013.01); *F17C 2205/0126* (2013.01); *F17C 2205/0165* (2013.01); *F17C 2205/0323* (2013.01); *F17C 2209/224* (2013.01); *F17C 2260/011* (2013.01)

(58) Field of Classification Search
USPC ..... 220/4.16, 4.13, 4.12, 4.01, 739; 206/0.6; 24/333, 331, 329, 328, 327; 292/257, 292/283; 222/3, 609, 608, 173, 183

See application file for complete search history.

(56) References Cited

U.S. PATENT DOCUMENTS

| | | | | |
|---|---|---|---|---|
| 4,782,977 | A * | 11/1988 | Watanabe | B65D 55/024 220/324 |
| 6,386,384 | B1 | 5/2002 | Chohfi et al. | |
| 7,255,245 | B2 * | 8/2007 | Oliveira | F17C 1/04 220/586 |
| 7,699,188 | B2 | 4/2010 | Oliveira et al. | |
| 7,891,521 | B2 * | 2/2011 | Salice | A23G 1/30 215/235 |
| 2004/0188308 | A1 * | 9/2004 | Mulligan | F17C 13/084 206/509 |
| 2006/0065672 | A1 * | 3/2006 | Lecourt | F17C 1/04 222/3 |
| 2010/0147859 | A1 | 6/2010 | Chohfi et al. | |
| 2011/0210130 | A1 | 9/2011 | Ontjes et al. | |
| 2011/0284531 | A1 * | 11/2011 | Chen | A46B 17/04 220/4.21 |
| 2016/0076678 | A1 * | 3/2016 | Wiedemeier | F17C 1/02 285/65 |

* cited by examiner

SHROUD ASSEMBLY FOR A PORTABLE PRESSURIZED GAS CYLINDER

CROSS-REFERENCE TO RELATED APPLICATIONS

The subject application claims the benefit of priority from U.S. Provisional Patent Application Ser. No. 62/304,695 filed Mar. 7, 2016, the disclosure of which is herein incorporated by reference in its entirety.

BACKGROUND OF THE INVENTION

1. Field of the Invention

The subject invention is directed to portable pressurized gas cylinders, and more particularly, to a generally cube-shaped protective shroud assembly for a portable pressurized gas cylinder and a method of assembling the same.

2. Description of Related Art

A variety of pressurized gas cylinders have been used for storage and transportation of pressurized gas products for household and industrial uses. Many of these cylinders have traditionally been fabricated of steel. These are often referred to as Type 1 gas cylinders. An example of a steel pressure vessel is disclosed in commonly assigned U.S. Pat. No. 6,386,384 to Chohfi et al., the disclosure of which is incorporated herein by reference in its entirety.

Hybrid pressure vessels have also been designed. The typically include a thin metal liner and a composite overwrap material made of fiberglass and/or a similar material. These are often referred to as Type 3 gas cylinders. An example of a hybrid pressure vessel is disclosed in commonly assigned U.S. Pat. No. 7,699,188 to Oliveira et al., the disclosure of which is incorporated herein by reference in its entirety.

Portable gas cylinders such as those described by Chohfi et al. and Oliveira et al. are enclosed within a protective outer jacket formed from a durable, light-weight plastic material. These protective outer jackets are formed from multiple component parts that are assembled together around the gas cylinder in such a manner so that the valve port of the cylinder is readily accessible by a user and it includes integral handles for conveniently carrying the gas cylinder. Improvements in these protective jackets and methods of assembly would be beneficial in the art. The present invention provides such an improvement.

SUMMARY OF THE INVENTION

The subject invention is directed to a new and useful portable gas cylinder assembly that includes a gas cylinder having a central axis and a protective shroud assembly. The shroud assembly is configured to encase the gas cylinder and includes opposed half-sections that are mechanically connected to one other along a vertical plane that intersects the central axis of the gas cylinder. The shroud assembly further includes a base member for supporting a lower portion of the gas cylinder within the opposed half-sections, and a cover member for supporting an upper portion of the gas cylinder within the opposed half-sections.

Preferably, the gas cylinder is a hybrid pressure vessel that includes a thin metal liner and a composite overwrap, also referred to as a Type III gas cylinder. However, it is envisioned that the gas cylinder may be a more conventional steel cylinder, also referred to as a Type I gas cylinder.

The opposed half-sections of the shroud are preferably mechanically connected to one another through the intimate engagement of a plurality of deflectable tang sets within corresponding reception grooves that are each formed integral with the opposed half-sections. Preferably, the opposed half-sections of the shroud are further mechanically connected to one another by a plurality of separate horizontal clamps that are configured for locking engagement in corresponding horizontal recessed channels formed in the opposed half sections.

Each of the plurality of tang sets includes a pair of deflectable parallel legs each having a tapered head with an angled cam surface at a distal end thereof. Each reception groove includes cam surfaces having angled leading edges for interacting with the angled cam surfaces of the tapered heads of a tang set to compress the legs of the tang set together, and a trailing abutment surface for capturing the tapered heads of the tang set when the legs are released from compression by the cam surfaces of the groove.

Each of the plurality of horizontal clamps includes a finger having a pointed head for engagement between the parallel legs of a corresponding tang set and a plurality of inwardly projecting deflectable tang members for engaging corresponding abutment members formed within the horizontal channels formed in the opposed half-sections of the shroud. Each inwardly deflectable tang member includes a tapered head with an angled cam surface for interacting with an angled cam surface of a corresponding abutment member.

The subject invention is further directed to a protective shroud assembly for encasing a portable gas cylinder, which includes a generally cube-shaped housing having opposed half-sections mechanically connected to one other along a vertical plane intersecting a central axis of the housing through an intimate engagement of a plurality of tang sets within corresponding reception grooves that are each formed integral with the opposed half-sections, wherein each half-section of the shroud assembly includes an integrally formed carrying handle.

The subject invention is also directed to a method of constructing a portable gas cylinder assembly that includes the steps of providing a gas cylinder having a central axis, and encasing the gas cylinder in a protective shroud including opposed half-sections connected to one other along a vertical plane intersecting the central axis of the gas cylinder. The method includes constructing a gas cylinder that includes a thin metal liner and a composite overwrap.

The method further includes the step of mechanically connecting the two half-sections to one another through intimate engagement of a plurality of tang sets within corresponding reception grooves that are each formed integral with the opposed half-sections, and the step of mechanically connecting the two half-sections of the shroud to one another through engagement of a plurality of separate horizontal clamps in corresponding horizontal recessed channels formed in the opposed half sections.

These and other features of the subject invention and the manner in which it is manufactured, assembled and employed will become more readily apparent to those having ordinary skill in the art from the following enabling description of the preferred embodiments of the subject invention taken in conjunction with the several drawings described below.

BRIEF DESCRIPTION OF THE DRAWINGS

So that those skilled in the art to which the subject invention appertains will readily understand how to make, use and construct the portable gas cylinder assembly of the subject invention without undue experimentation, preferred embodiments thereof will be described in detail herein below with reference to certain figures, wherein:

FIGS. 8A-8E are a series of localized perspective views of an exemplary tang set of one shroud half section engaging a corresponding reception groove in an opposed shroud half-section, wherein:

FIG. 8A shows a reception groove having angled leading edges for interacting with the angled cam surfaces of the tapered heads of a tang set;

FIG. 8B shows the leading edges are configured to initially compress the legs of the tang set together;

FIG. 8C shows the camming surfaces maintain the legs in a compressed state;

FIG. 8D shows the trailing abutment surfaces that capture the tapered heads of the tang legs when the legs are released from compression by the camming surfaces of the reception groove; and FIG. 8E illustrates an audible signal or click being produced to indicate to a user that the components are engaged; and FIGS. 9A-9G are a series of localized perspective views of a horizontal clamp engaging a corresponding horizontal channel in the assembled shroud half sections, wherein:

FIGS. 9A-9C show a truss frame having an elongated pointed finger for engagement between the parallel legs of a corresponding tang; and FIGS. 9D-9G show integrally formed inwardly projecting deflectable tang members engaging corresponding abutment members integrally formed within the horizontal channels formed in an opposed half section, and wherein upon capture of the tang members by abutments members an audible signal is produced.

DETAILED DESCRIPTION OF PREFERRED EMBODIMENTS

Figure 1:
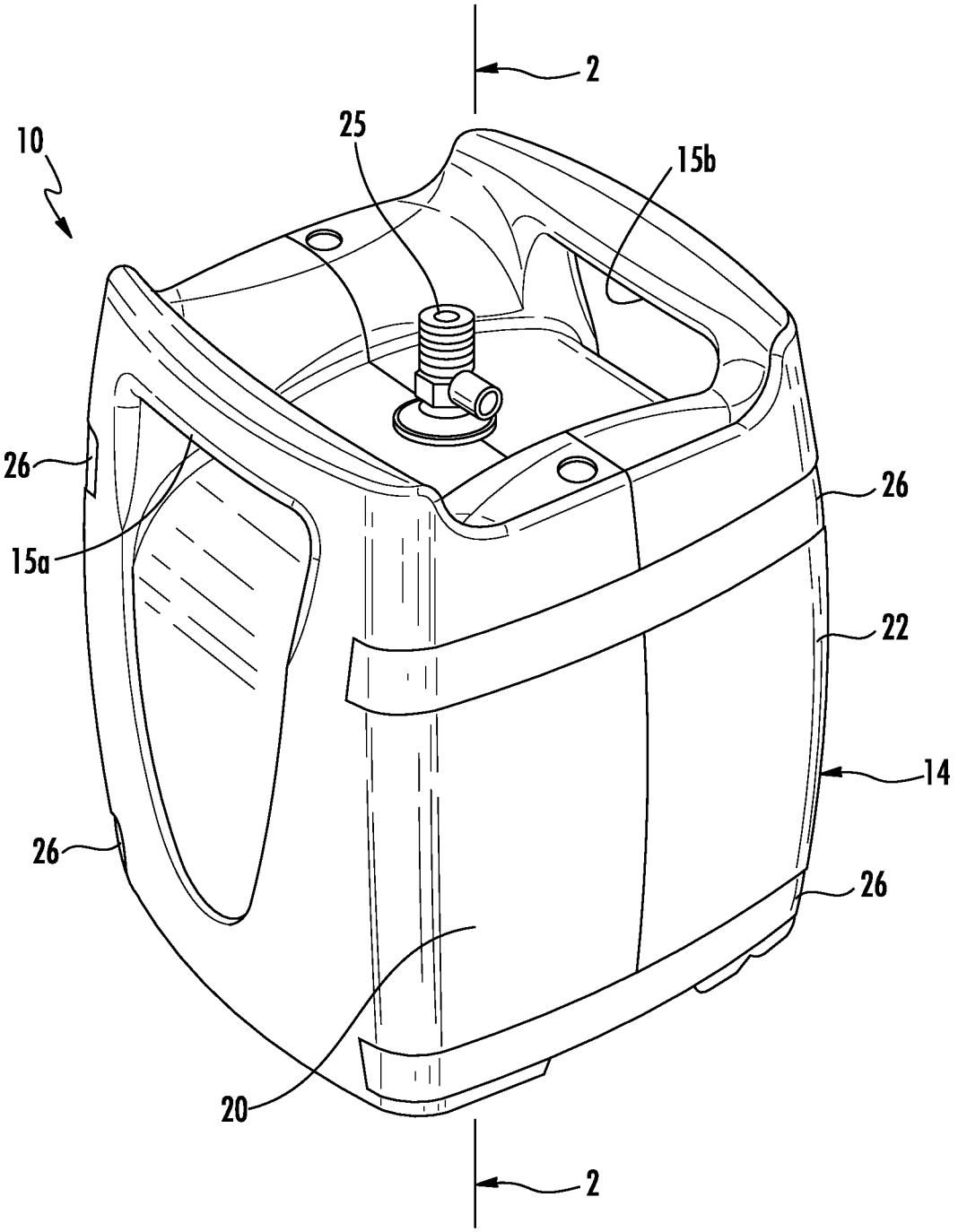
FIG. 1 is a perspective view of a portable gas cylinder assembly constructed in accordance with a preferred embodiment of the subject invention, which includes a generally cube-shaped protective outer shroud.
Figure 2:
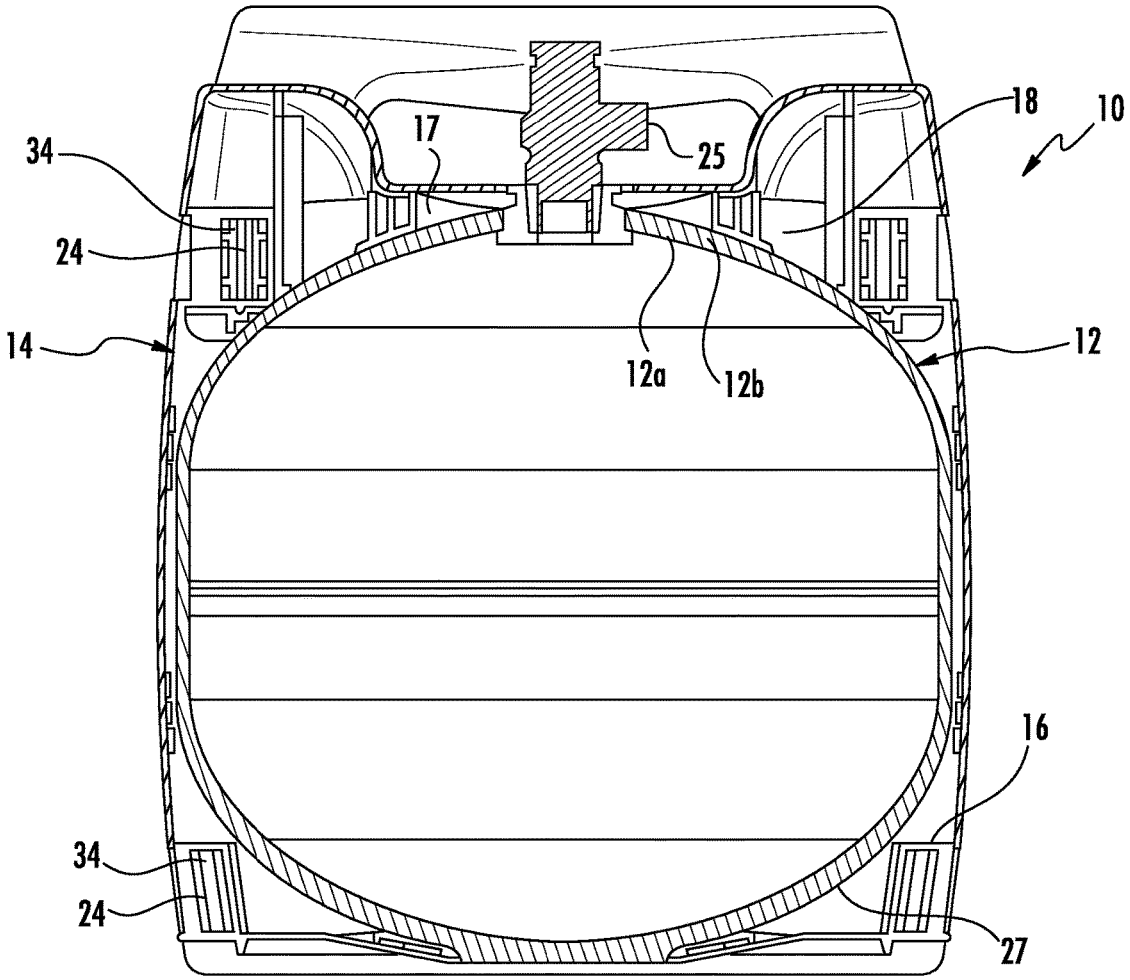
FIG. 2 is a cross-sectional view taken along line 2-2 of FIG. 1 illustrating the internal components and structural features of the portable gas cylinder assembly of the subject invention.

Referring now to the drawings, wherein like reference numerals identify similar structural features or aspects of the subject invention, there is illustrated in FIG. 1 a new and unique portable gas cylinder assembly designated generally by reference numeral 10. The portable gas cylinder assembly 10 includes a gas cylinder 12 having a central axis and a generally cube-shaped protective outer shroud 14 that is configured to encase the gas cylinder 12, as shown in FIG. 2. The outer shroud 14 is preferably formed from a lightweight, durable plastic material and includes integrally formed ergonomically shaped handles 15*a* and 15*b* that are designed for carrying the portable gas cylinder assembly 10.

Preferably, the gas cylinder 12 is a hybrid pressure vessel including a thin metal liner 12*a* and a composite overwrap 12*b*, also referred to as a Type III gas cylinder. An example of a hybrid pressure vessel is disclosed in commonly assigned U.S. Pat. No. 7,699,188 to Oliveira et al. The overwrap can be fiberglass or a similar material that can be readily wrapped around the gas cylinder. However, it is envisioned that the gas cylinder may be a more conventional steel cylinder, also referred to as a Type I gas cylinder. An example of a steel pressure vessel is disclosed in commonly assigned U.S. Pat. No. 6,386,384 to Chohfi et al.

Figure 3:
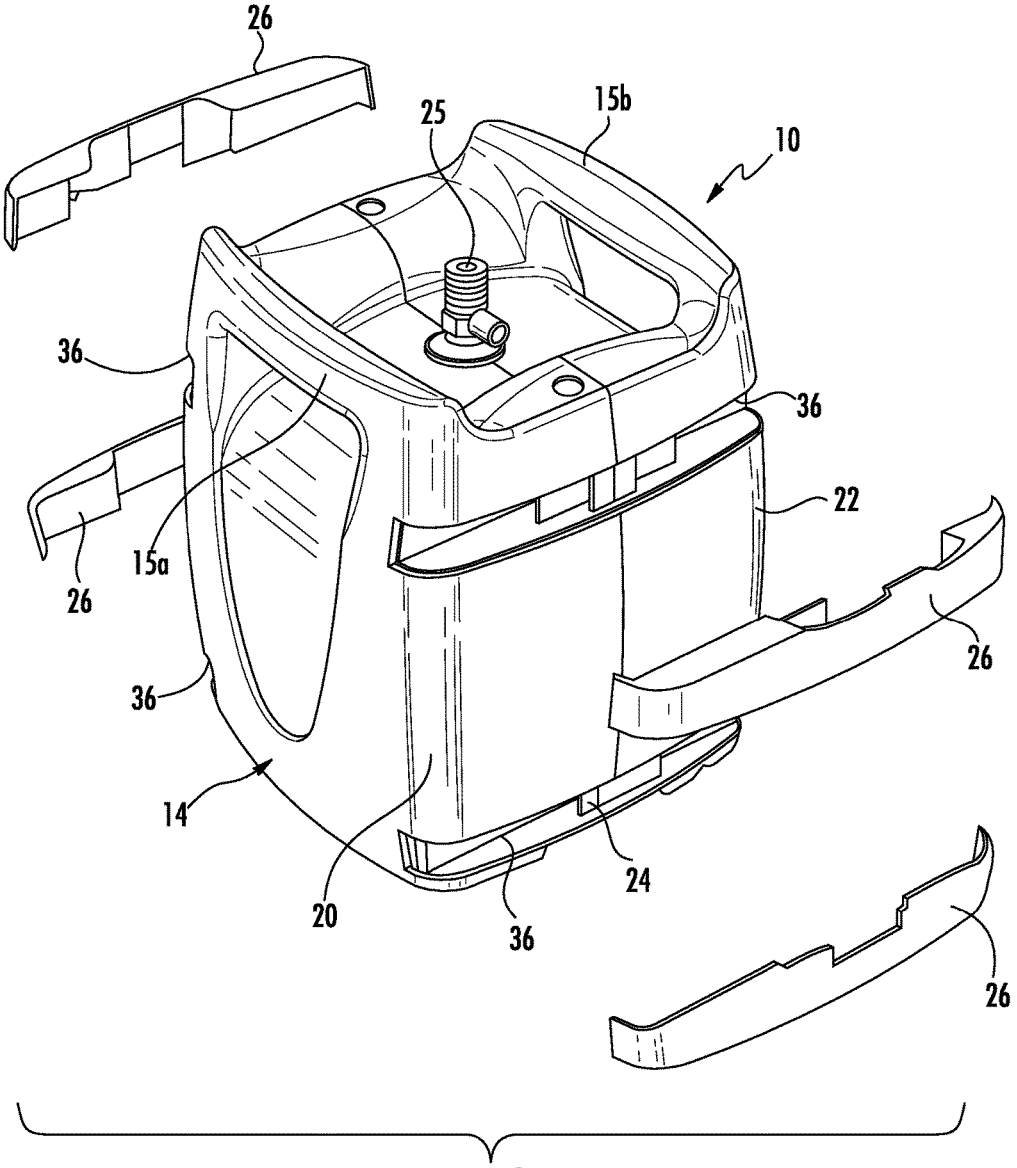
FIG. 3 is an exploded perspective view of the portable gas cylinder assembly shown in FIG. 1, with the horizontal clamps separate from the shroud for ease of illustration.
Figure 4:
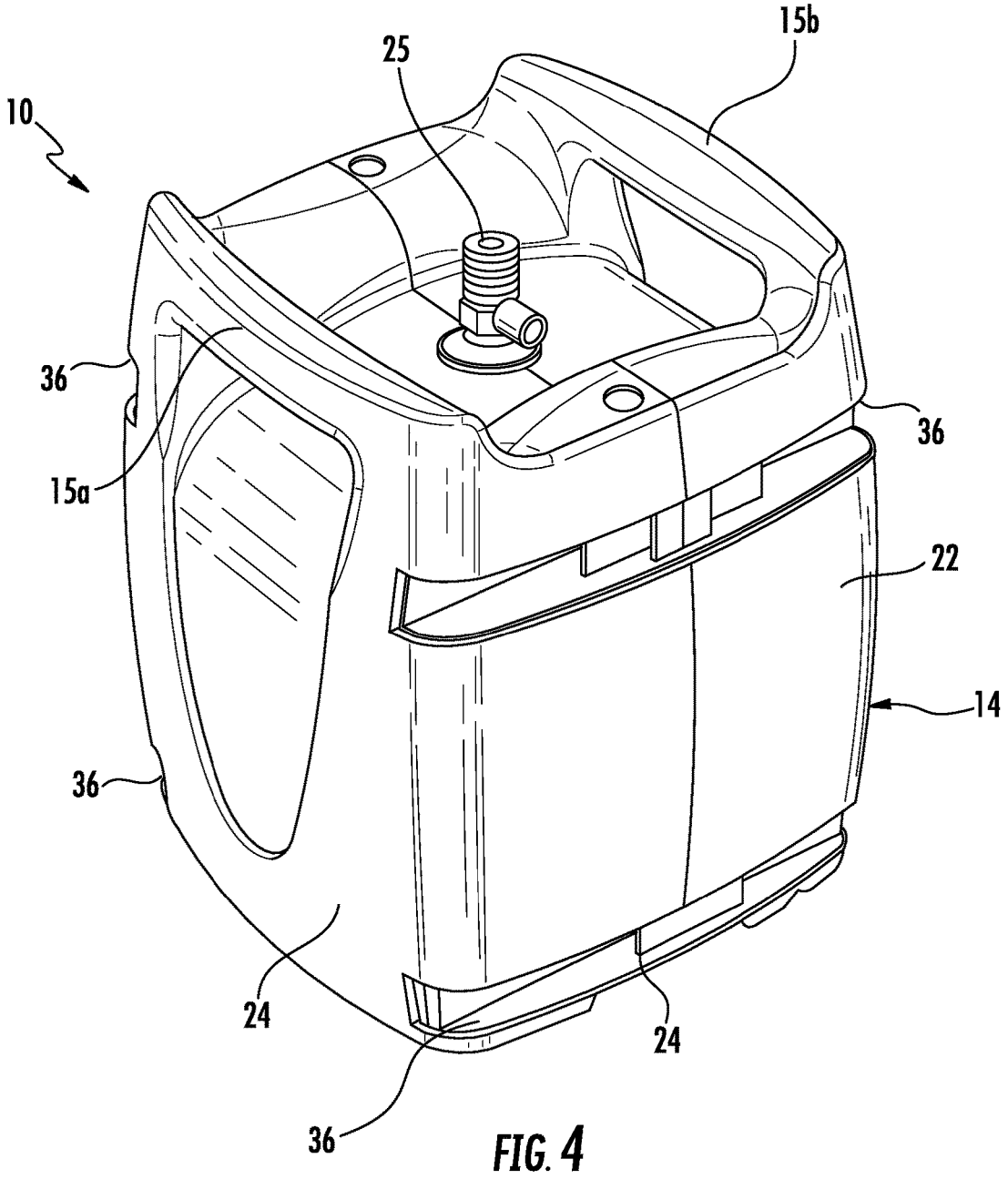
FIG. 4 is a perspective view of the portable gas cylinder assembly shown in FIG. 1, with the horizontal removed from the shroud to illustrate the horizontal reception channels.
Figure 5:
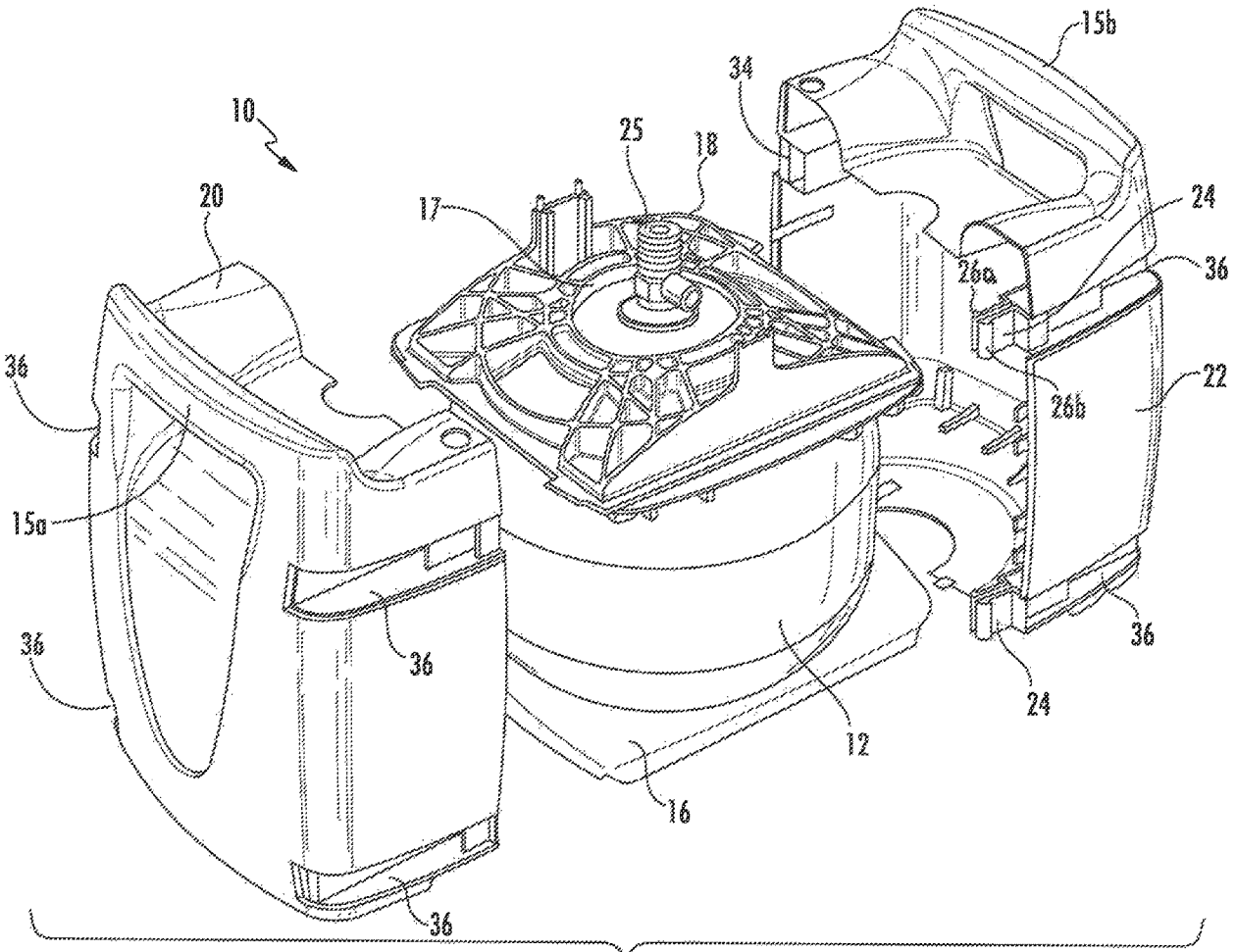
FIG. 5 is an exploded perspective view of the portable gas cylinder assembly as shown in FIG. 4, with the two half-sections of the shroud separated to illustrate the gas cylinder, with a base member for supporting the lower portion of the gas cylinder and cover member for supporting the upper portion of the gas cylinder.

As best seen in FIGS. 3 through 5, the cube-shaped protective outer shroud 14 includes opposed half-sections 20 and 22, which are mechanically connected to one other along a vertical plane intersecting the central axis of the gas cylinder 12. More particularly, the opposed half-sections 20 and 22 of the shroud 14 are mechanically connected to one another through the intimate engagement of a plurality of deflectable tangs 24 within corresponding reception grooves 34 that are each formed integral with the opposed half-sections 20 and 22. This intimate mechanical engagement will be described in greater detail below with reference to FIGS. 8A-8E.

Figure 6:
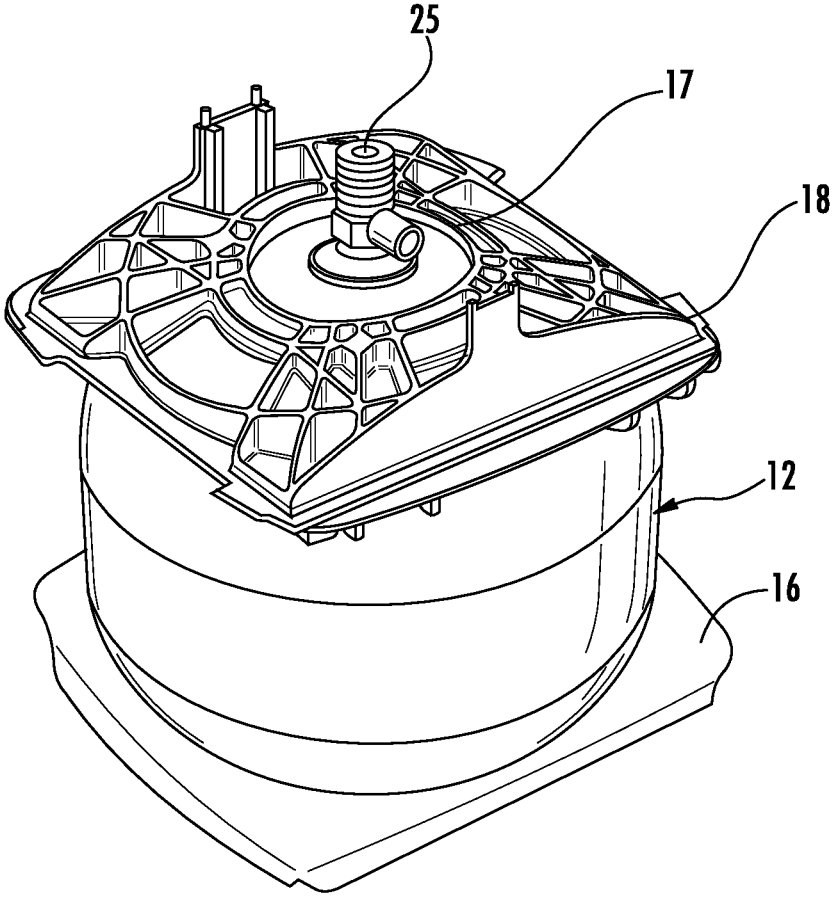
FIG. 6 is a perspective view of the gas cylinder shown in FIG. 5, along with the base member and cover member, separated from the shroud.
Figure 7:
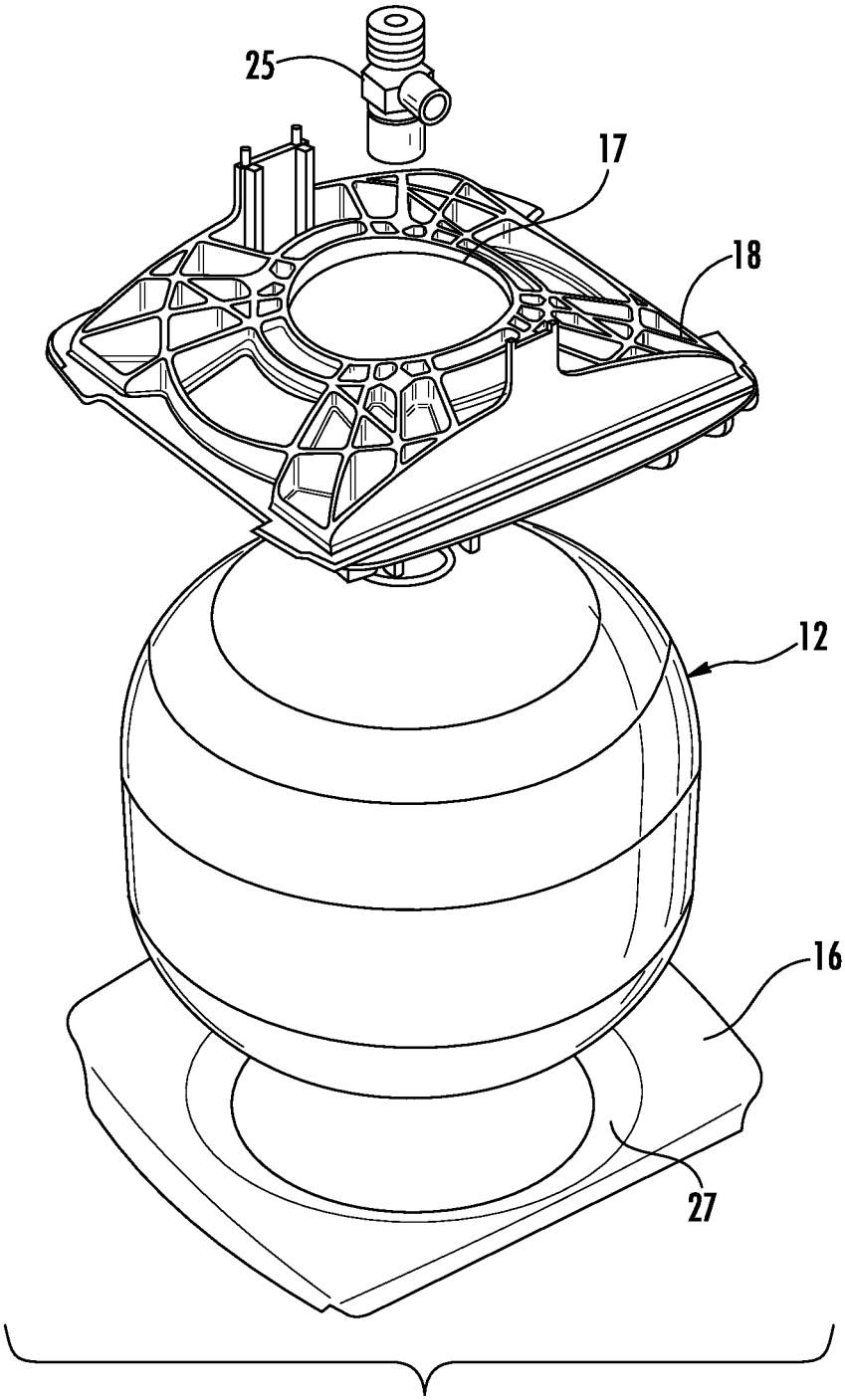
FIG. 7 is an exploded perspective view of the gas cylinder, where the cover and base members are separated from the gas cylinder, along with the valve member.

Referring now to FIGS. 6 and 7, the shroud 14 further includes a base member 16 for supporting a lower portion of the gas cylinder 12 within the opposed half-sections 20 and 22 of shroud 14, and a cover member 18 for supporting an upper portion of the gas cylinder 12 within the opposed half-sections of shroud 14. A central aperture 17 is formed in cover member 18 for accommodating the standard fill valve 25 of gas cylinder 12. A recessed seat 27 is formed in the base for receiving the rounded lower portion of the gas cylinder 12.

Referring to FIG. 5, each of the half-sections 20, 22 of shroud 14 include two sets of tangs 24 (upper and lower) and two reception grooves 34 (upper and lower). Each of the plurality of tang sets 24 includes a pair of deflectable parallel legs 26*a*, 26*b*. Each leg 26*a*, 26*b* has a tapered head 28*a*, 28*b* that has an angled cam surface 30*a*, 30*b* formed at a distal end thereof.

Figure 8A:
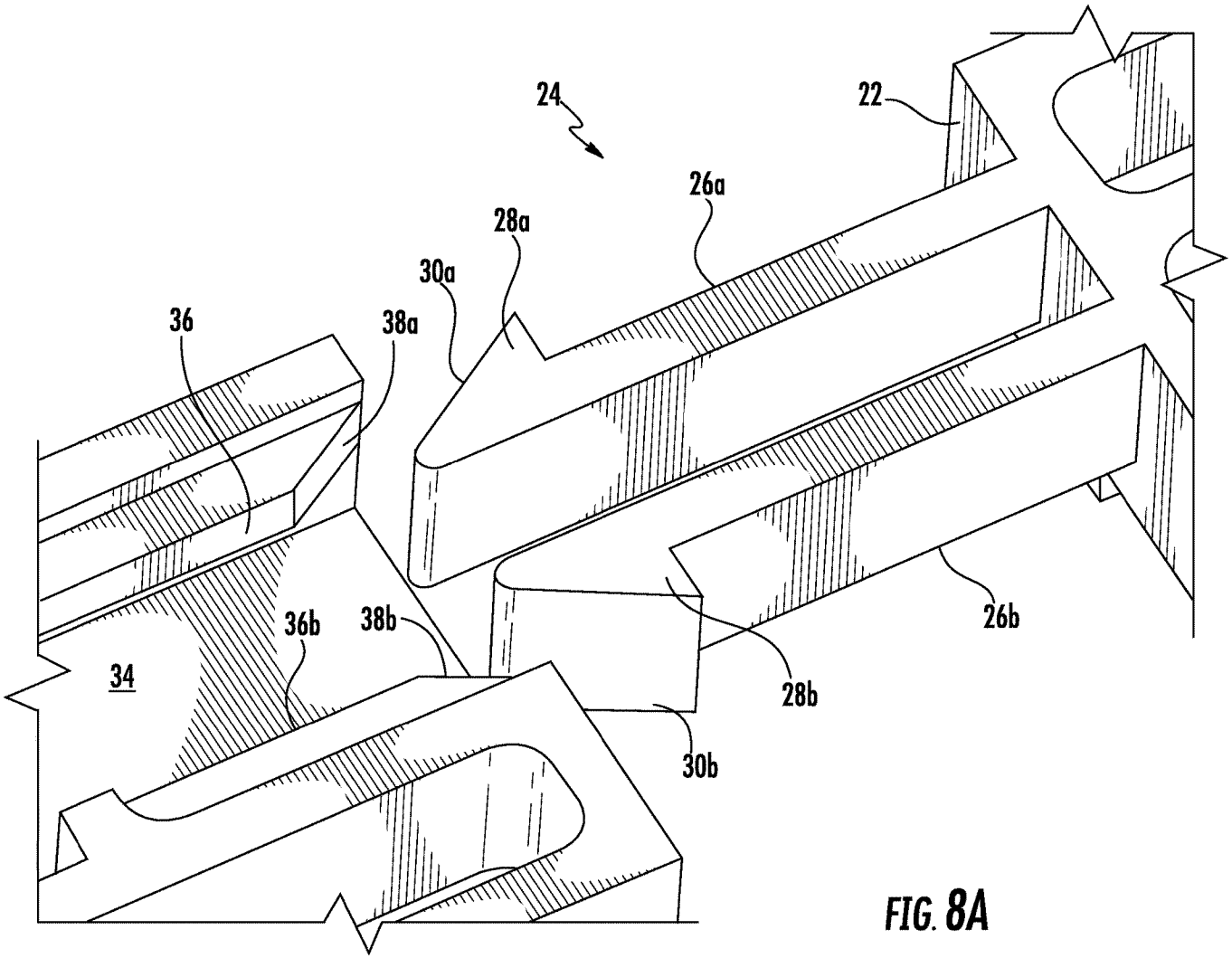
Figure 8B:
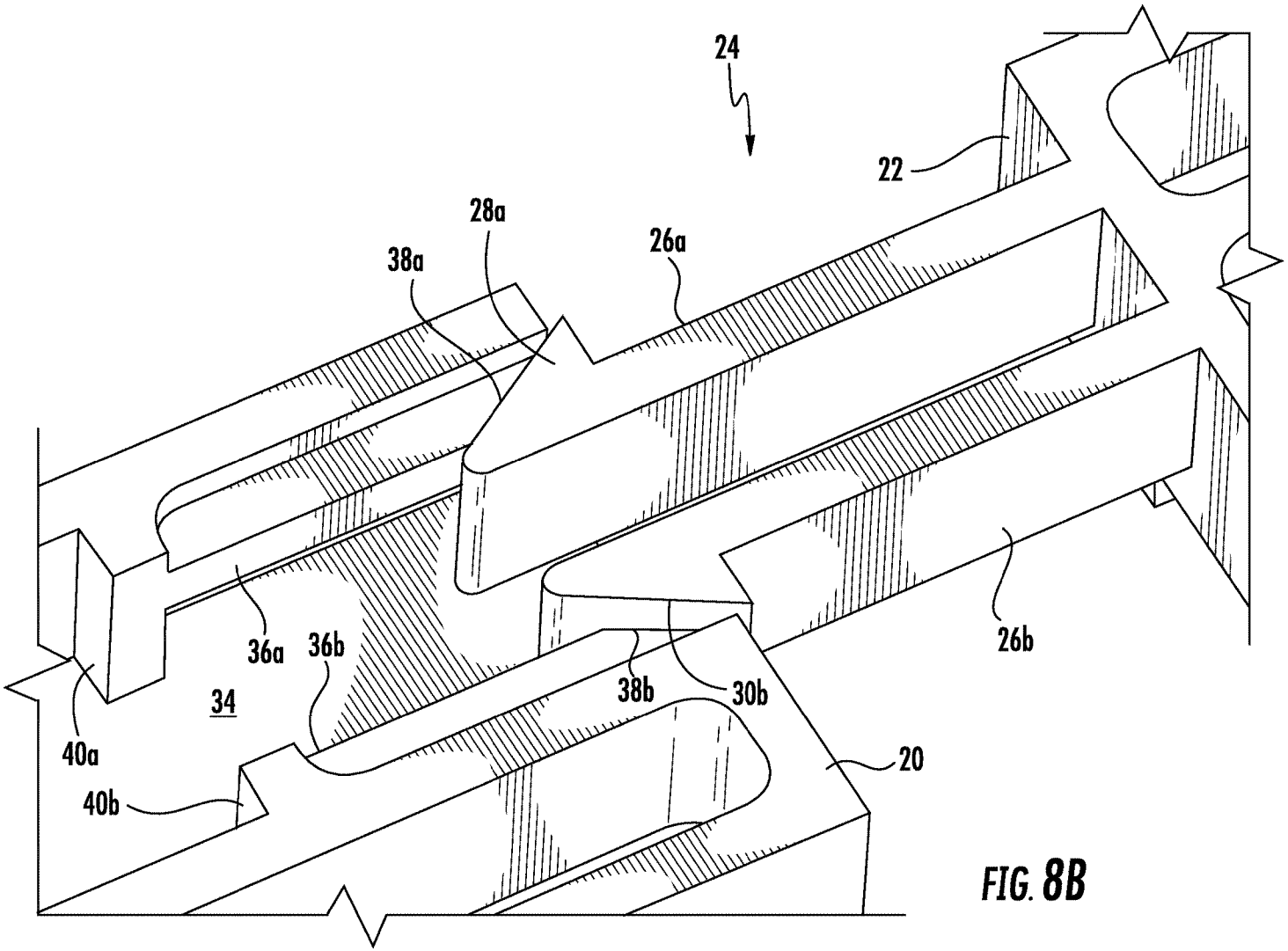
Figure 8C:
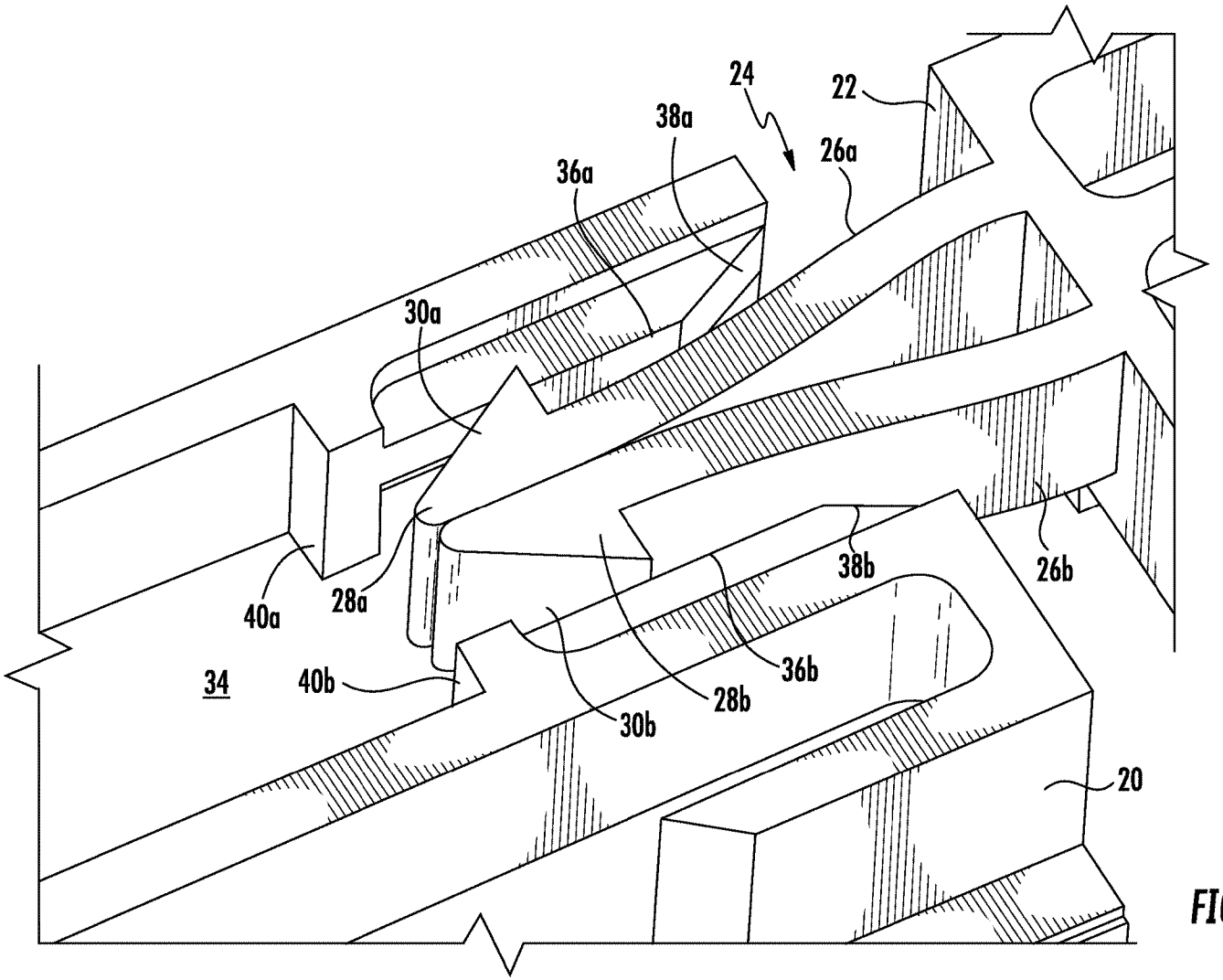
Figure 8D:
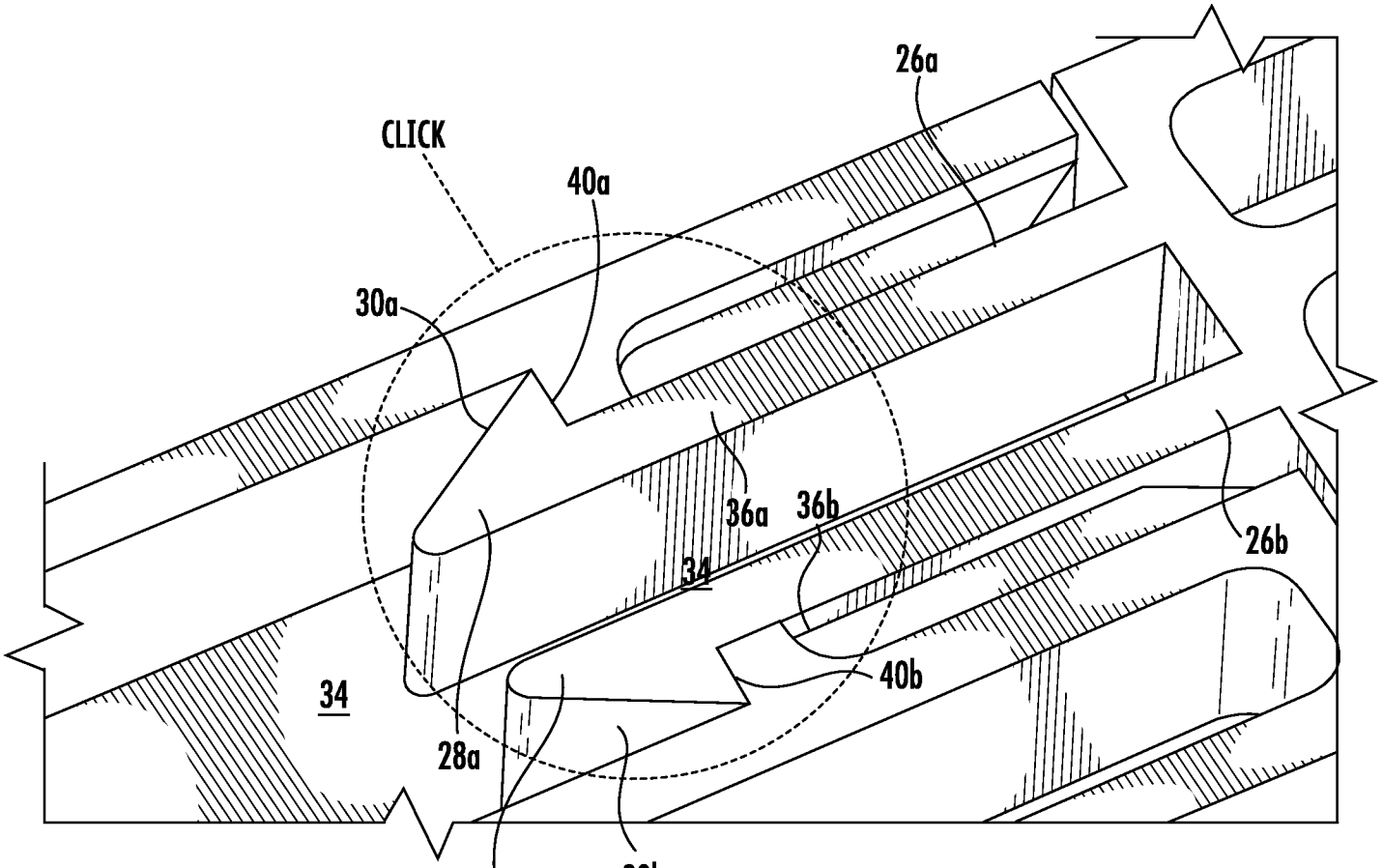
Figure 8E:
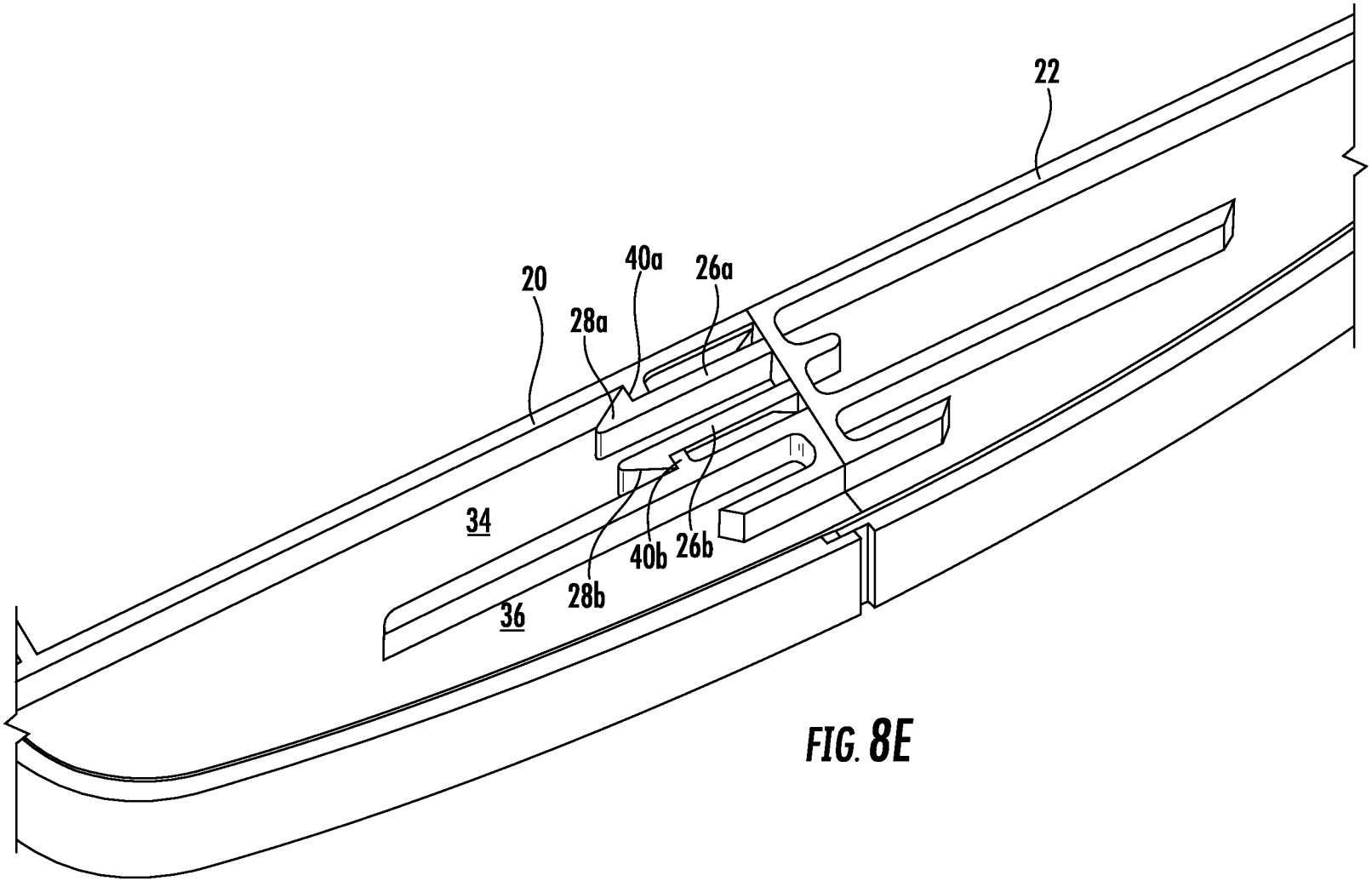

Referring now to FIGS. 8A-8E, each reception groove 34 includes a pair of opposed cam surface 36*a*, 36*b* having angled leading edges 38*a*, 38*b*. The cam surfaces 36*a*, 36*b* are configured for interacting with the angled cam surfaces 30*a*, 30*b* of the tapered heads 28*a*, 28*b* of a tang set 24, as shown in FIG. 8A. More particularly, the leading edges 38*a*, 38*b* are configured to initially compress the legs 26*a*, 26*b* of the tang set 24 together, as shown in FIG. 8B. The camming surfaces 36*a*, 36*b* maintain the legs 26*a*, 26*b* in a compressed state, as shown in FIG. 8C. The trailing abutment surfaces 40*a*, 40*b* of the reception groove 34 capture the tapered heads 28*a*, 28*b* of the tang legs 26*a*, 26*b* when the legs 26*a*, 26*b* are released from compression by the camming surfaces 36*a*, 36*b* of the reception groove 34, as shown in FIG. 8D. Upon capture, an audible signal or click is produced to indicate to a user that the components are properly engaged, which is best illustrated in FIG. 8E.

Referring now to FIGS. 9A-9G, the opposed half-sections 20 and 22 of the shroud 14 are further mechanically connected to one another by a plurality of separate horizontal clamps 26 that are configured for locking engagement in corresponding horizontal channels 36 formed in both opposed half-sections 20 and 22. More particularly, there are four (4) clamps 26, two on each side of the shroud 14 (see FIG. 3).

Figure 9A:
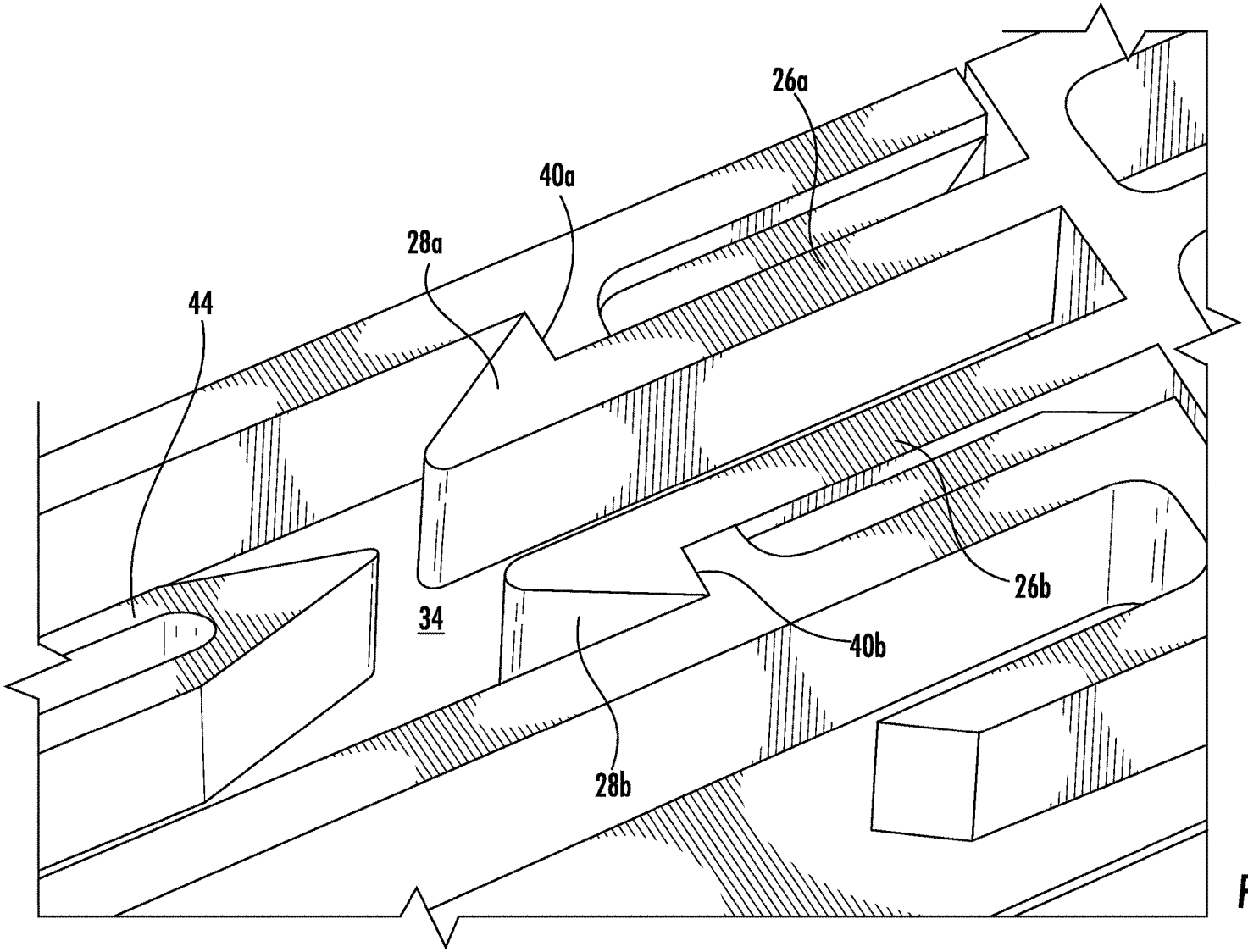
Figure 9B:
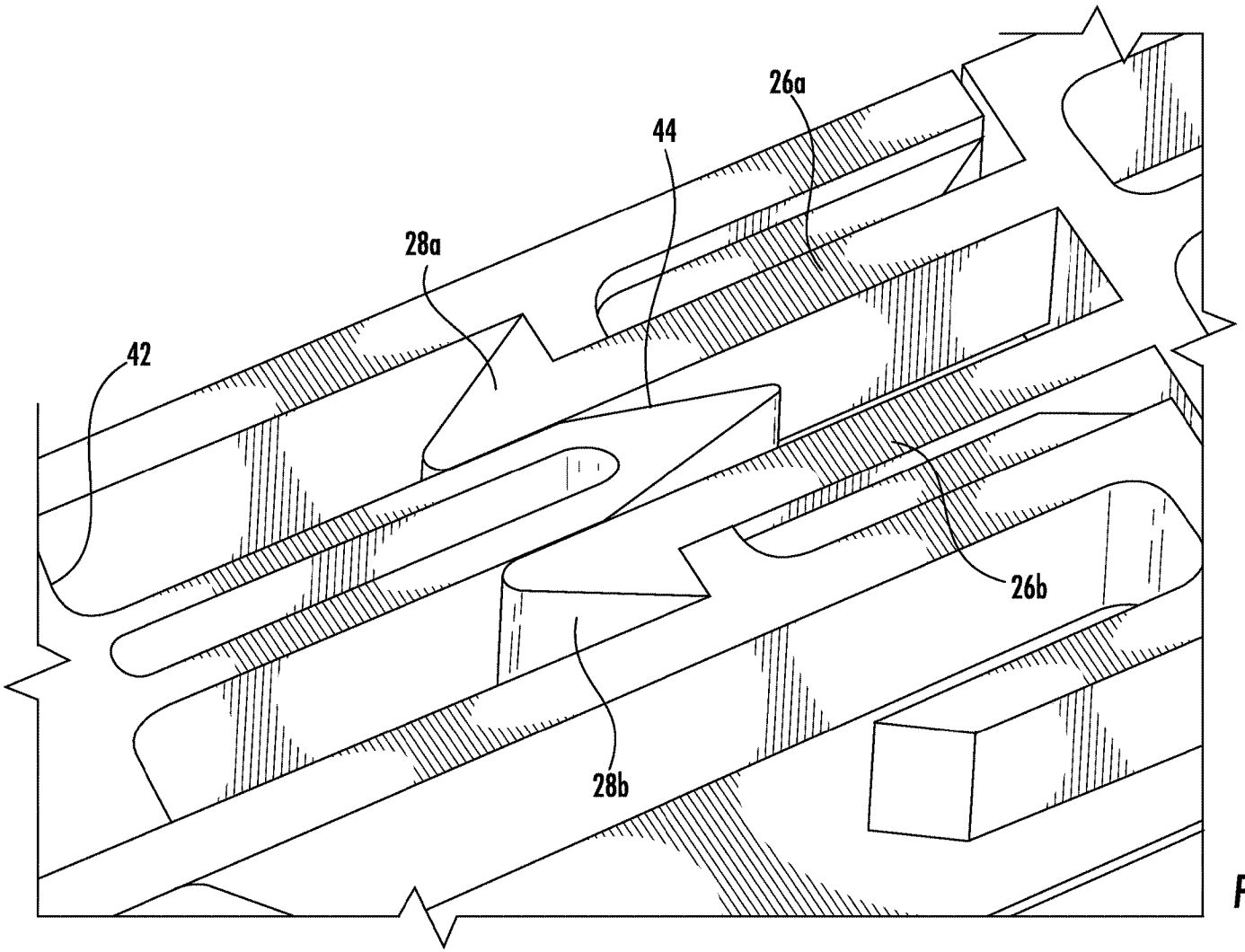
Figure 9C:
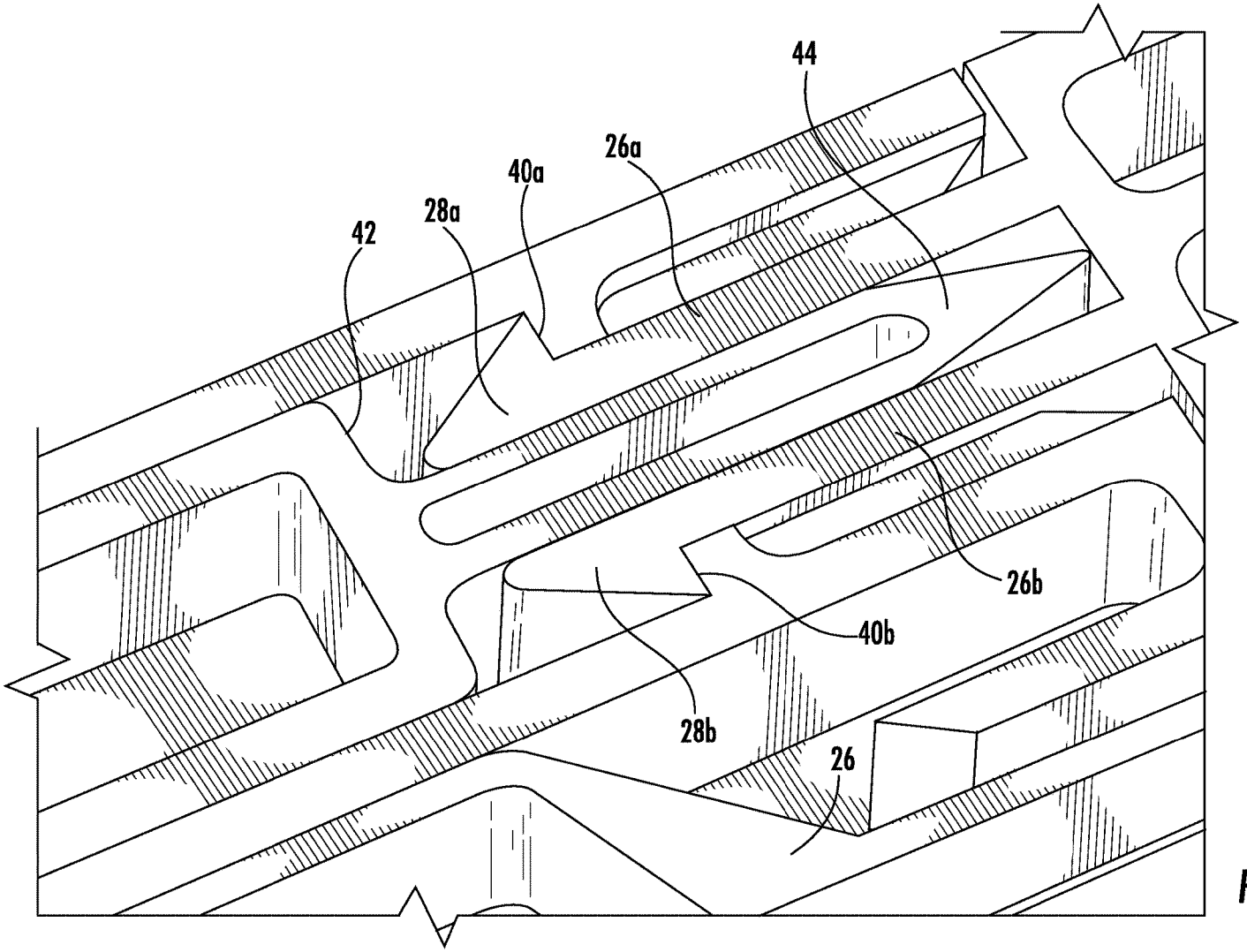
Figure 9D:
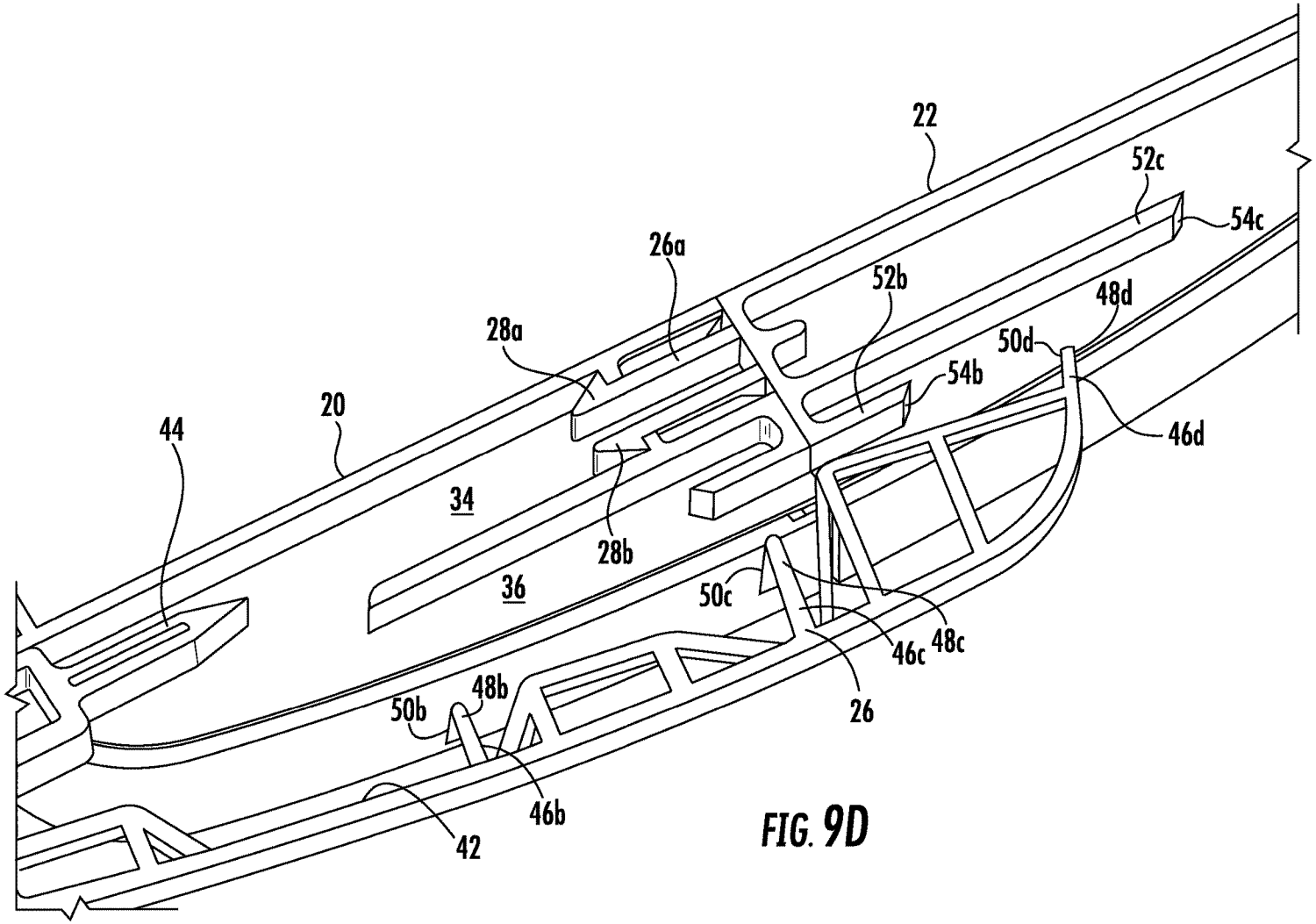
Figure 9E:
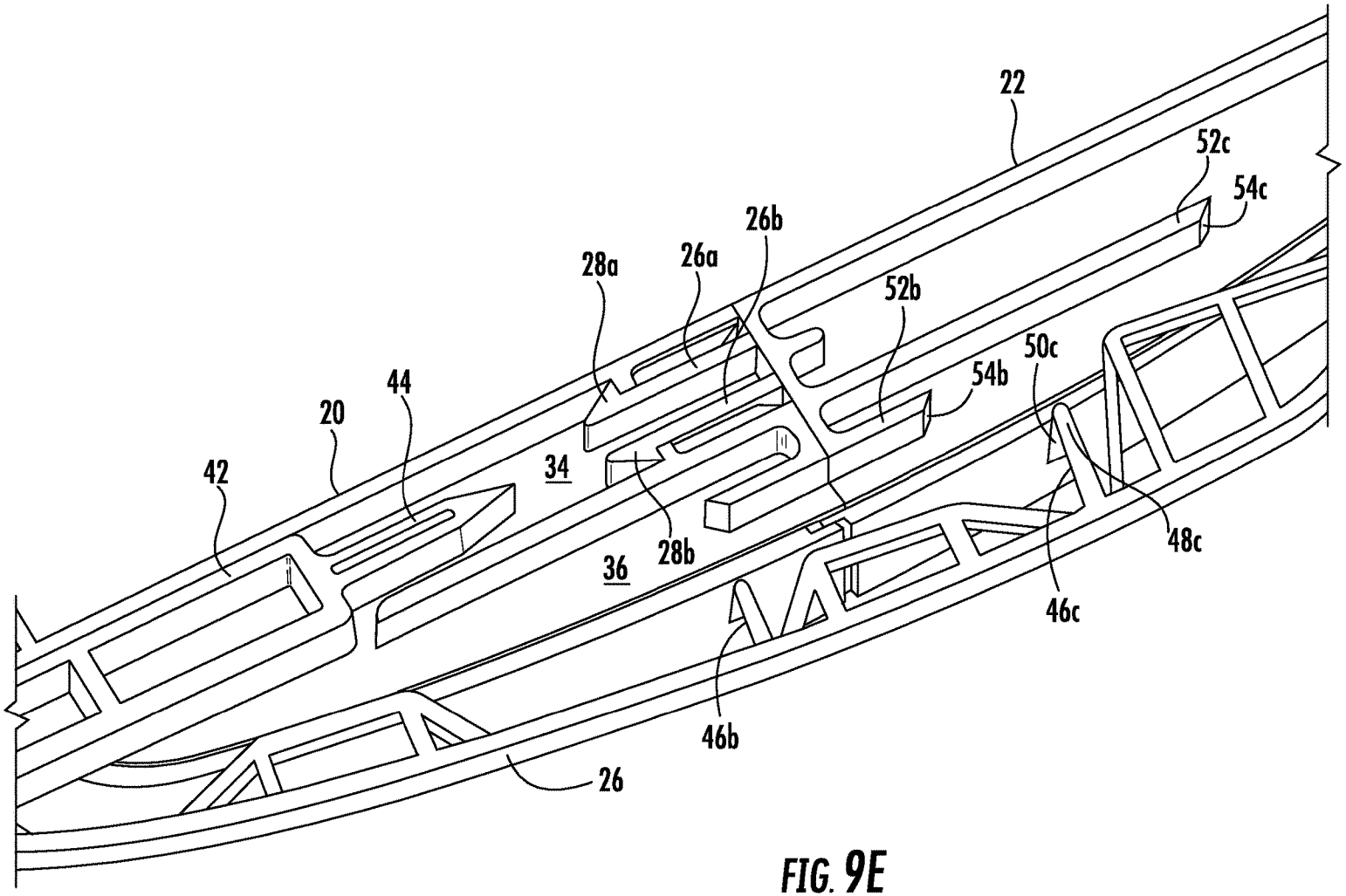
Figure 9F:
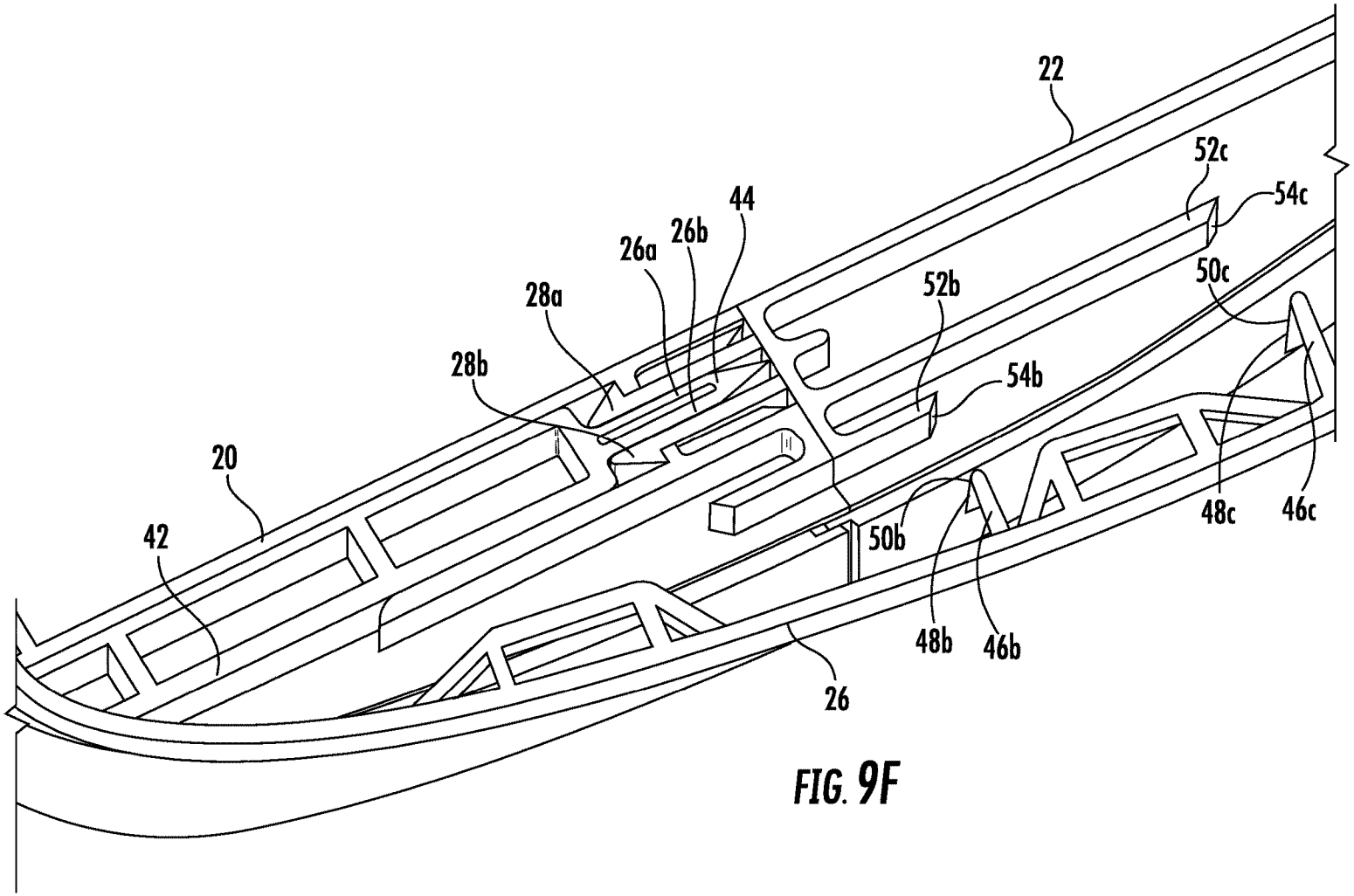

Each of the plurality of horizontal clamps 26 includes a truss frame 42 having an elongated pointed finger 44 for engagement between the parallel legs 26*a*, 26*b* of a corresponding tang 24, as best seen in FIGS. 9A-9C. Each of the four horizontal clamps 26 further includes four (4) integrally formed inwardly projecting deflectable tang members 46*a*-46*d*. These tang members 46*a*-46*d* are configured to engage corresponding abutment members 56*a*-56*d* that are integrally formed within the horizontal channels 36 defined in the opposed half-sections 20 and 22, as best seen in FIGS. 9D-9G. The size of each tang member on the frame 42 of each clamp 26 differs as does the size of each abutment member in each channel 36.

Figure 9G:
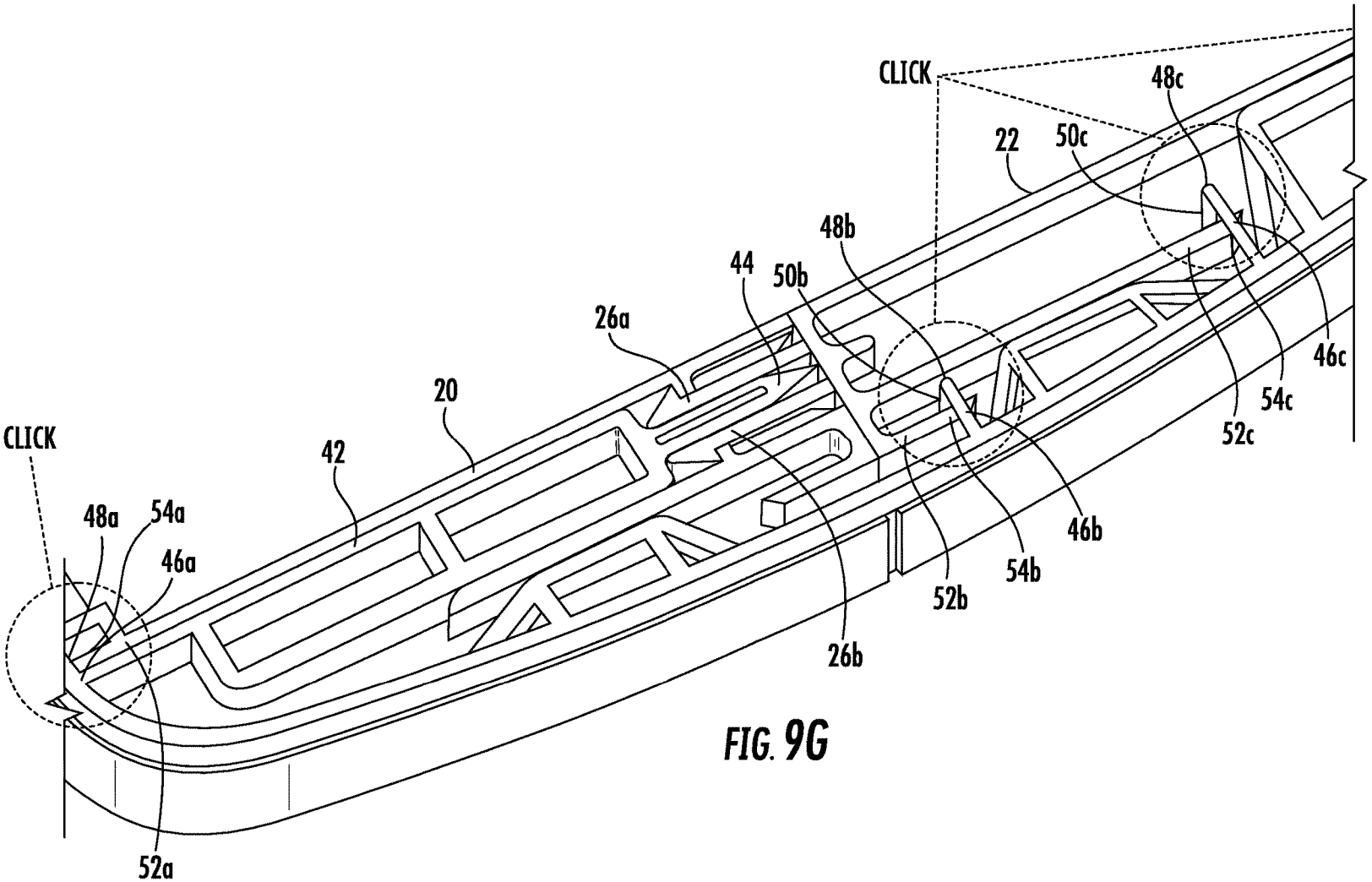

Each inwardly deflectable tang member 46*a*-46*d* on the frame 42 of clamp 26 includes a respective tapered head 48*a*-48*d* with an angled cam surface 50*a*-50*d*. The angled cam surfaces 50*a*-50*d* are configured to interact with angled cam surface 54*a*-54*d* of corresponding abutment member 52*a*-52*d* defined in the channels 36 of shroud half-sections 20 and 22. The interaction of the angled cam surfaces 54*a*-54*d* of abutment members 52*a*-52*d* and the angled cam surfaces 54*a*-54*d* of the tapered heads 48*a*-48*d*, causes the tang members 46*a*-46*d* to deflect until the tapered heads 48*a*-48*d* of each tang member 46*a*-46*d* are captured by the respective abutment members 52*a*-52*d*. Upon capture of the tang members 46*a*-46*d* by abutments members 52*a*-52*d*, an audible signal or click is produced to indicate to a user that the components are engaged, which is best illustrated in FIG. 9G.

While the protective shroud assembly of the subject invention has been shown and described with reference to preferred embodiments, those skilled in the art will readily appreciate that various changes and/or modifications may be made thereto without departing from the spirit and scope of the subject invention as defined by the appended claims.

What is claimed is:

1. A portable gas cylinder assembly comprising:

a gas cylinder having a central axis;

a protective shroud configured to encase the gas cylinder and including first and second opposed half-sections mechanically connected to one other along a vertical plane intersecting the central axis of the gas cylinder through engagement of a plurality of tang sets within corresponding reception grooves that are each formed integral with the first and second opposed half-sections, wherein each of the first and second opposed half-sections include a plurality of recessed channels, and wherein each of the recessed channels in the first half-section is adjacent one of the recessed channels in the second half-section when the sections are mechanically connected to one another; and a plurality of horizontal clamps separate from the shroud that are configured for locking engagement in adjacent recessed channels to further mechanically connect the opposed first and second half-sections, wherein each of the plurality of horizontal clamps is configured for locking engagement in one of the recessed channels in the first half-section and the adjacent one of the recessed channels in the second half-section.

2. A portable gas cylinder assembly as recited in claim 1, further including a base member separate from the opposed half-sections of the protective shroud for supporting a lower portion of the gas cylinder within the opposed half-sections, wherein the base member has a recessed seat formed therein for receiving a rounded lower portion of the gas cylinder.

3. A portable gas cylinder assembly as recited in claim 1, wherein the shroud further includes a cover member for supporting an upper portion of the gas cylinder within the opposed half-sections.

4. A portable gas cylinder assembly as recited in claim 1, wherein each of the plurality of tang sets includes a pair of deflectable parallel legs each having a tapered head with an angled cam surface at a distal end thereof.

5. A portable gas cylinder assembly as recited in claim 4, wherein each reception groove includes cam surfaces having angled leading edges for interacting with the angled cam surfaces of the tapered heads of the tang set to compress the parallel legs of the tang set together, and each reception groove includes trailing abutment surfaces for capturing the tapered heads of the tang set when the parallel legs are released from compression.

6. A portable gas cylinder assembly as recited in claim 1, wherein each of the plurality of horizontal clamps include a finger having a pointed head for engagement between the parallel legs of a corresponding tang set and a plurality of inwardly projecting deflectable tang members for engaging corresponding abutment members formed within the horizontal channels formed in the opposed half-sections of the shroud.

7. A portable gas cylinder assembly as recited in claim 6, wherein each inwardly projecting deflectable tang member includes a tapered head with an angled cam surface for interacting with an angled cam surface of a corresponding abutment member formed in the horizontal recessed channel.

8. A portable gas cylinder assembly as recited in claim 1, wherein the gas cylinder is a hybrid pressure vessel including a thin metal liner and a composite overwrap.

9. A portable gas cylinder assembly as recited in claim 1, wherein each half-section of the shroud includes an integrally formed carrying handle.

10. A protective shroud assembly for encasing a portable gas cylinder, the shroud assembly comprising:

a generally cube-shaped housing including opposed half-sections separate from one another and mechanically connected to one other along a vertical plane intersecting a central axis of the housing through an intimate engagement of a plurality of tang sets within corresponding reception grooves that are each formed integral with the opposed half-sections and engage on opposing sides of the half-sections, wherein each half-section of the shroud assembly includes an integrally formed carrying handle, wherein a cover member, separate from the housing, supports an upper portion of the gas cylinder within the opposed half-sections of the housing, and a base member, separate from the housing, supports a lower portion of the gas cylinder within the opposed half-sections of the housing, wherein the opposed half-sections of the shroud assembly are further mechanically connected to one another by a plurality of separate horizontal clamps that are configured for locking engagement in corresponding horizontal recessed channels that are formed in the opposed half sections and that open to outer side surfaces of the opposed half-sections.

11. A protective shroud assembly as recited in claim 10, wherein each of the plurality of tang sets includes a pair of deflectable parallel legs each having a tapered head with an angled cam surface at a distal end thereof.

12. A protective shroud assembly as recited in claim 11, wherein each reception groove includes cam surfaces having angled leading edges for interacting with the angled cam surfaces of the tapered heads of the tang set to compress the parallel legs of the tang set together, and each reception groove includes trailing abutment surfaces for capturing the tapered heads of the tang set when the parallel legs are released from compression.

13. A protective shroud assembly as recited in claim 12, wherein each of the plurality of horizontal clamps include a finger having a pointed head for engagement between the parallel legs of a corresponding tang set and a plurality of inwardly projecting deflectable tang members for engaging corresponding abutment member formed within the horizontal channels formed in the opposed half-sections of the shroud.

14. A protective shroud assembly as recited in claim 13, wherein each inwardly projecting deflectable tang members includes a tapered head with an angled cam surface for interacting with an angled cam surface of a corresponding abutment member formed in the horizontal recessed channel.

* * * * *